United States Patent [19]

Kobayashi et al.

[11] Patent Number: 4,495,926

[45] Date of Patent: Jan. 29, 1985

[54] APPARATUS FOR CONTROLLING THE FUEL SUPPLY OF AN INTERNAL COMBUSTION ENGINE

[75] Inventors: Nobuyuki Kobayashi; Takashi Hattori, both of Toyota, Japan

[73] Assignee: Toyota Jidosha Kabushiki Kaisha, Toyota, Japan

[21] Appl. No.: 566,418

[22] Filed: Dec. 28, 1983

[30] Foreign Application Priority Data

Apr. 4, 1983 [JP] Japan ..... 58-57779

[51] Int. Cl.[3] ..... F02M 51/02

[52] U.S. Cl. ..... 123/486; 123/488

[58] Field of Search ..... 123/478, 486, 487, 488, 123/480

[56] References Cited

U.S. PATENT DOCUMENTS

| | | | |
|---|---|---|---|
| 3,960,120 | 6/1976 | Aono et al. | 123/488 X |
| 4,348,727 | 9/1982 | Kobayashi et al. | 123/480 X |
| 4,365,299 | 12/1982 | Kondo et al. | 123/480 X |
| 4,401,087 | 8/1983 | Ikeura | 123/480 X |
| 4,436,073 | 3/1984 | Miyagi | 123/480 X |
| 4,440,136 | 4/1984 | Denz et al. | 123/480 X |
| 4,442,812 | 4/1984 | Mizuno et al. | 123/480 X |

*Primary Examiner*—Tony M. Argenbright

*Attorney, Agent, or Firm*—Cushman, Darby & Cushman

[57] ABSTRACT

The fuel supply to an internal combustion engine is controlled by fuel injection signals that depend on the intake manifold pneumatic pressure PM and the engine running speed NE. The basic pulse width TP of the fuel injection signal is calculated from the equation $TP=(TPBSE+TPNE)TPKNE$, where TPBSE is taken from a one-dimensional function table PM-TPBSE, TPNE is taken from a one-dimensional function table NE-TPNE, and TPKNE is taken from a one-dimensional function table NE-TPKNE.

5 Claims, 7 Drawing Figures

APPARATUS FOR CONTROLLING THE FUEL SUPPLY OF AN INTERNAL COMBUSTION ENGINE

BACKGROUND OF THE INVENTION

1. Field of the Invention

The present invention relates to a fuel supply control apparatus for an internal combustion engine.

2. Description of the Prior Art

In one known fuel supply control method using a programmed microcomputer, the engine running speed and the intake manifold pneumatic pressure are measured with sensors and then used to calculate the basic pulse width of an injection signal to be applied to the fuel injectors. This basic pulse width is corrected in accordance with other engine operating parameters such as the oxygen concentration of the exhaust gases, the coolant temperature, the ambient temperature, and the degree of acceleration. The corrected pulse-width is used to adjust actual fuel feed.

In the preceding method developed by the present applicant, which is not yet known to the art, one-dimensional function tables that give the relationship between the basic pulse width and the intake manifold pneumatic pressure or engine running speed are provided in a storage device beforehand. A basic pulse width corresponding to the detected engine parameters is found from these function tables by interpolation. First, a pulse width TPBSE is found from a one-dimensional function table for the intake manifold pneumatic pressure, and a correction coefficient TPKNE is found from a one-dimensional function table relating the engine running speed. A basic pulse width TP is then calculated by multiplying the pulse width TPBSE by the correction coefficient TPKNE, which corrects for deviations in the intake efficiency of the engine. In other words, the basis pulse width TP is obtained from the equation $TP=TPBSE\times TPKNE$.

However, when the above-described method is used, the calculated basic pulse width always has an error greater than ten percent under certain operating conditions, relative to the basic pulse width actually required by the engine. As a result, the controlled air-fuel ratio deviates from the correct value under certain operating condition, causing the exhaust gas purification and other operating characteristics of the engine to deteriorate. In order to avoid such erroneous calculations of the basic pulse width, a two-dimensional function table or more than two one-dimensional function tables must be utilized. However, such a function table or tables complicates the pulse width control program. In addition, such tables take up a great deal of storage capacity.

SUMMARY OF THE INVENTION

It is therefore an object of the present invention to provide an apparatus for controlling the fuel supply of an internal combustion engine, whereby a basic pluse width that is correct to within only a small error can be obtained without increasing the length of the control program or the storage capacity required for function tables used to calculate the basic pulse width.

The above object is achieved by a fuel supply control apparatus comprising: means for detecting the intake manifold pneumatic pressure and producing a first electrical signal; means for detecting the engine running speed and producing a second electrical signal; means for calculating, in response to the first electrical signal, a first fuel supply amoung TPBSE from at least one one-dimensional function the variable for which is the intake manifold pneumatic pressure; means for calculating, in response to the second electrical signal, a second fuel supply amount TPNE from a one-dimensional function the variable for which is the engine running speed; means for calculating, in response to the second electrical signal, a correction coefficient TPKNE from a one-dimensional function the variable for which is the engine running speed; means for calculating, from the calculated first and second fuel supply amounts TPBSE and TPNE and from the correction coefficient TPKNE, a third fuel supply amount TP, the calculation being performed by using the function $TP=(TPBSE+TPNE)TPKNE$; and means for adjusting, in accordance with the calculated third fuel supply amount, the actual fuel supply to the engine.

The above and other related objects and features of the present invention will be apparent from the description of the present invention set forth below, with reference to the accompanying drawings, as will as from the appended claims.

DESCRIPTION OF THE PREFERRED EMBODIMENTS

Figure 1:
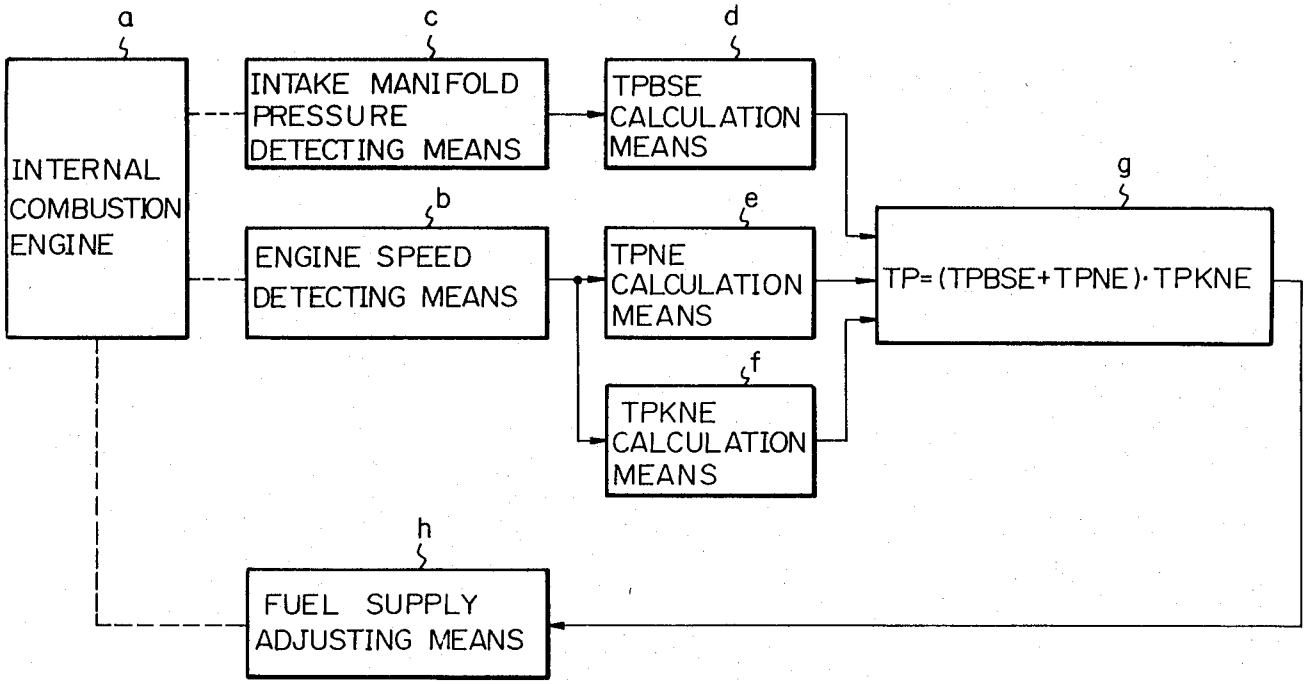
FIG. 1 is a flow diagram of the present invention.

FIG. 1 is a flow diagram of a fuel supply control apparatus according to the present invention. In FIG. 1, reference symbol a denotes an internal combustion engine, b denotes a means for detecting the intake manifold pneumatic pressure of the engine a, and c denotes a means for detecting the engine running speed. A TPBSE calculation means d calculates, in response to the detected manifold pressure, a first fuel supply amount TPBSE from at least one one-dimensional function representing the relationship between the intake manifold pneumatic pressure and TPBSE. A TPNE calculation means e calculates, in response to the detected engine speed, a second fuel supply amount TPNE from a one-dimensional function representing the relationship between the engine running speed and TPNE. A TPKNE calculation means f calculates, in response to the detected engine speed, a correction coefficient TPKNE from a one-dimensional function representing the relationship between the engine running speed and TPKNE. A TP calculation means q calculates a third fuel supply amount TP from the function $TP=(TPBSE+TPNE)TPKNE$. An adjusting means h adjusts the actual fuel supply to the engine according to the calculated TP.

Figure 2:
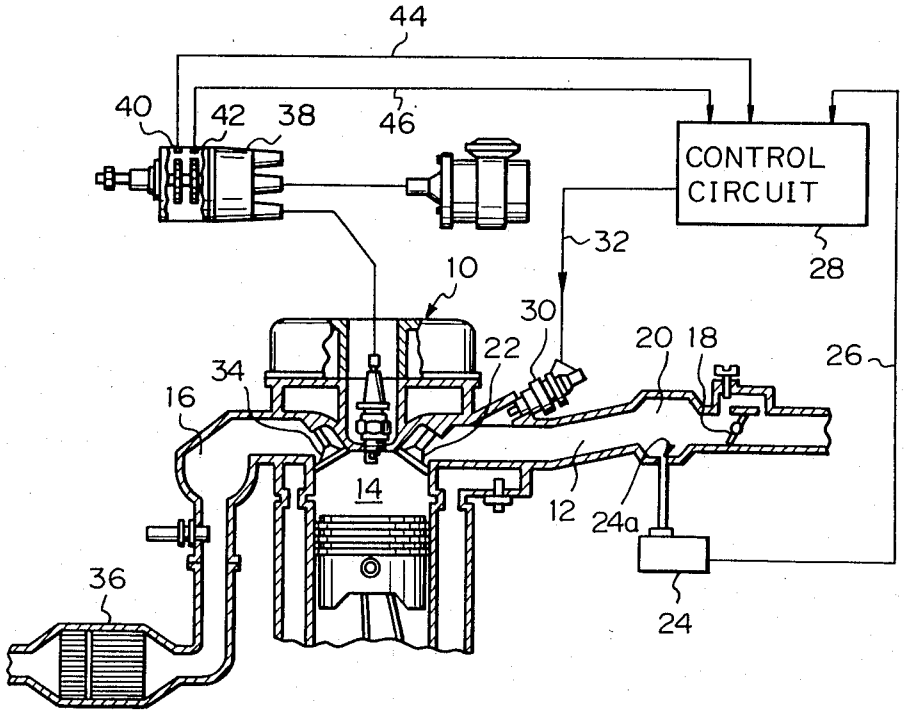
FIG. 2 is a schematic diagram of an embodiment of an electronic fuel injection control system of an internal combustion engine according to the present invention.

FIG. 2 illustrates an embodiment of the present invention.

In FIG. 2, reference numeral 10 denotes an engine body, 12 an air intake passage, 14 a combustion chamber, and 16 an exhaust passage. The flow rate of outer air introduced into the engine through an air cleaner (not shown) is controlled by a throttle valve 18 interlocked with an accelerator pedal (not shown). The air passing through the throttle valve 18 is introduced into the combustion chamber 14 via a surge tank 20 and an intake valve 22.

In the intake passage 12, at a position downstream from the throttle valve 18, such as at the surge tank 20, a pressure take-out port 24*a* is opened. The pressure take-out port 24*a* communicates with a pneumatic pressure sensor 24 which detects the absolute pneumatic pressure in the intake manifold and produces a voltage corresponding to the detected pressure. The output voltage from the pneumatic pressure sensor 24 is transmitted to a control circuit 28 via a signal line 26.

Each of a number of fuel injectors 30 for the cylinders is opened and closed in response to electrical drive pulses transmitted from the control circuit 28 via a signal line 32. The fuel injectors 30 intermittently inject compressed fuel from a fuel supply system (not shown) into the intake passage 12 in the vicinity of the intake valve 22.

The exhaust gases produed by fuel combustion in the combustion chamber 14 are discharged into the atmosphere via an exhaust valve 34, the exhaust passage 16, and catalytic converter 36.

Crank angle sensors 40 and 42 disposed in a distributor 38 produce pulse signals at each rotation of 30° and 360°, respectively. The pulse signals produced at each 30° rotation are fed to the control circuit 28 via a signal line 44. The pulse signals produced at each 360° crank angle are fed to the control circuit 28 via a signal line 46.

Figure 3:
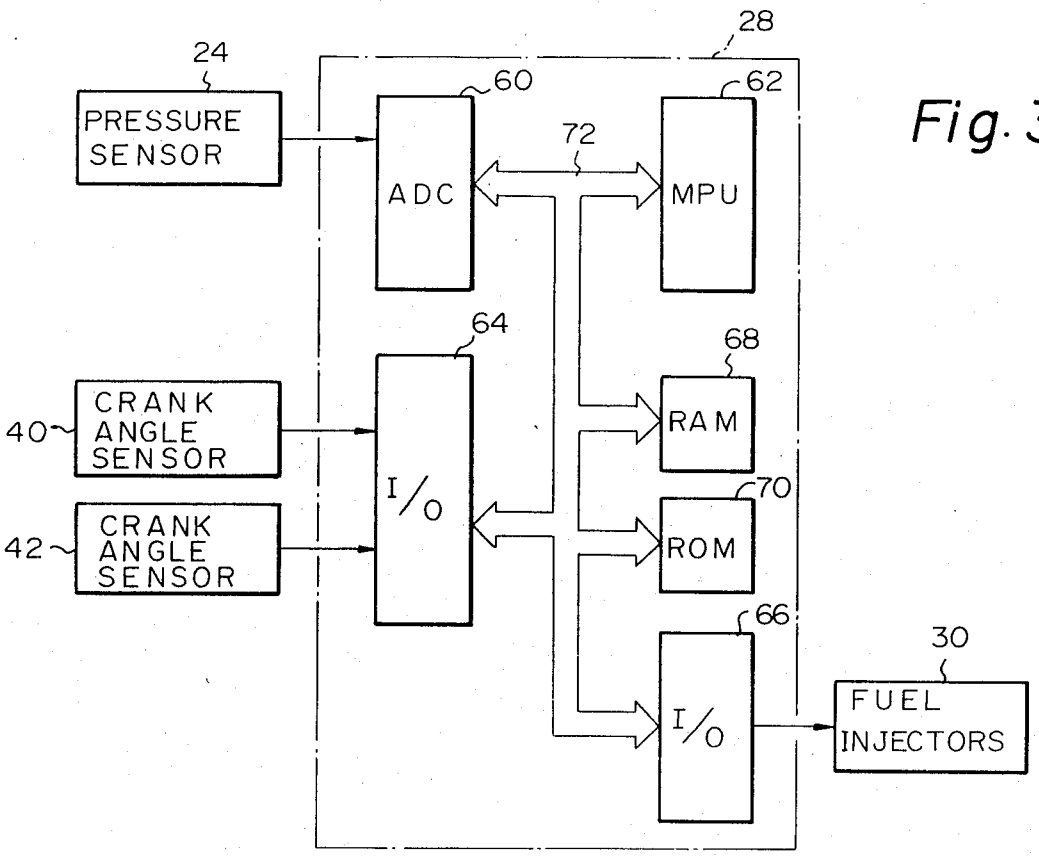
FIG. 3 is a block diagram of the control circuit shown in FIG. 2.

FIG. 3 illustrates an example of the control circuit 28 of FIG. 2. In FIG. 3, the pneumatic pressure sensor 24, crank angle sensors 40 and 42, and fuel injectors 30 are represented by boxes.

The output voltage from the pneumatic pressure sensor 24 and from other sensors (not shown) are applied to an analog-to-digital (A/D) converter 60 that contains an analog multiplexer and A/D converter, and are sequentially converted into binary signals in accordance with instructions from a microprocessor unit (MPU) 62.

The pulse signals produced by the crank angle sensor 40 every 30° of rotation are fed to the MPU 62 via an input-output (I/O) circuit 64 as interrupt-request signals for the interruption routine for each 30° crank angle. The pulse signals from the crank angle sensor 40 are also transmitted to a timing counter disposed in the I/O circuit 64 as counting pulses. The pulse signals produced by the crank angle sensor 42 at each 360° crank angle are used as reset pulses for the above timing counter. The timing counter produces fuel-injection initiation pulses that are fed to the MPU 62 as interrupt-request signals for the injection interruption routine.

A drive circuit that receives a one-bit injection pulse having a pulse width TAU calculated by the MPU 62 and converts the injection pulse into a drive signal is provided in an I/O circuit 66. The drive signal from the drive circuit is fed to the fuel injectors 30 for the injection into the cylinders of a quantity of fuel corresponding to the pulse width TAU.

The A/D converter 60 and I/O circuits 64 and 66 are connected via a bus 72 to the MPU 62, a random access memory (RAM) 68, and a read only memory (ROM) 70, which constitute the microcomputer. The data are transferred via the bus 72.

A routine program for main processing, an interrupt-processing program executed at every 30° crank angle, and another routine program are stored beforehand in the ROM 70, as are also various types of data or tables necessary for carrying out arithmetic calculations.

The operation of the microcomputer will now be illustrated with reference to the flow diagrams in FIGS. 4 and 5.

Figure 4:
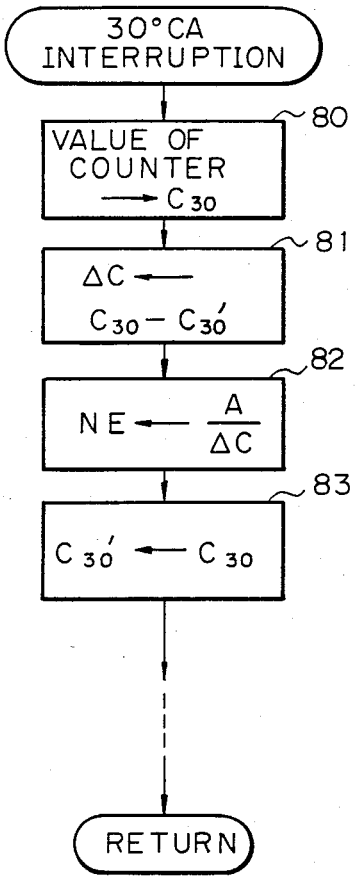
FIGS. 4 and 5 are flow diagrams of parts of the control programs of a microcomputer in the control circuit of FIG. 3.

When the pulse signal produced at each 30° crank angle is applied from the crank angle sensor 40, the MPU 62 executes the interrupt-processing routine shown in FIG. 4 for producing rpm data to indicate the running speed NE of the engine.

At a point 80, the contents of a free-run counter provided in the MPU 62 are read out and temporarily stored in a register in the MPU 62 as $C_{30}$. At a point 81, the difference $\Delta C$ between the contents $C_{30}$ of the free-run counter read out in the present interruption process and the contents $C_{30}'$ of the free-run counter, read out in the preceding interruption process, is calculated as $\Delta C = C_{30} - C_{30}'$. Then, at a point 82, the reciprocal of the difference $\Delta C$ is calculated to obtain the running speed $NE = A/\Delta C$, where A is a constant. The calculated NE is stored in the RAM 68. At a point 83, the contents $C_{30}$ in the present interruption process are stored in the RAM 68 as the contents $C_{30}'$ of the free-run counter in the preceding interruption process, and are used in the next interruption process. Another process is then executed in the interrupt-processing routine following which the program returns to the main processing routine.

The MPU 62 further introduces binary signals which correspond to the output voltages of the pneumatic pressure sensor 24 and another sensor from the A/D converter 60 in response to the interrupt request which occurs at the completion of each A/D conversion. The MPU 62 then stores the introduced binary signals in the RAM 68.

Figure 5:
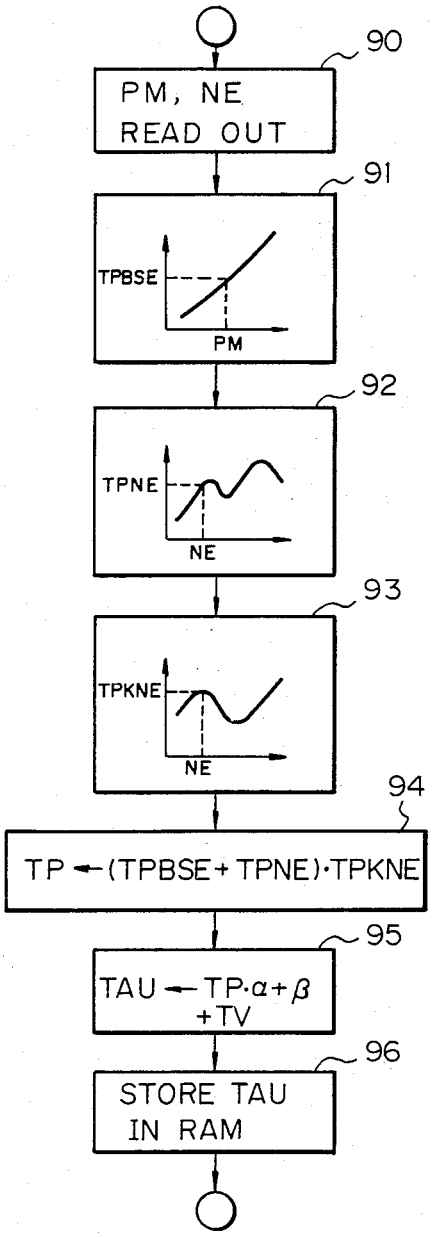

During the main processing routine or during an interrupt-processing routine executed at each 1800 crank angle, the MPU 62 executes the operations, shown in FIG. 5, for calculating the pulse width TAU of the fuel injection signal. First, at a point 90, the MPU 62 reads out the data related to intake manifold pneumatic pressure PM and engine running speed NE from the RAM 68. At a point 91, the MPU 62 finds a first pulse width TPBSE, using the detected intake manifold pressure PM, from a one-dimensional function table that shows the relationship between the intake manifold pressure PM and the first pulse width TPBSE. Interpolation is used to find the TPBSE corresponding to the PM. If each item of the function table is composed of 16 or more bits, TPBSE can be accurately obtained by using only one one-dimensional function table of PM-TPBSE. If each item of the function table is composed of just one byte (8-bits), it is preferable to use two one-dimensional function tables to obtain the TPBSE. In the latter case, TPMAIN and TPSUB are found by using a PM-TPMAIN function table and a PM-TPSUB function table as shown in Table 1 and 2, respectively. The least significant bit (LSB) of the PM-TPMAIN function table is expressed in units of 32 microseconds and the LSB of the PM-TPSUB function table is expressed in units of 8 microseconds. TPBSE is then calculated from the following equation, $$TP = TPMAIN \times 32 + TPSUB \times 8$$

The latter method can be used to accurately obtain TPBSE even when function tables consisting of one-byte items are used.

TABLE 1

| PM | 100 | 200 | 300 | 400 | 500 | 600 | 700 | 800 | 900 |
|---|---|---|---|---|---|---|---|---|---|
| TPMAIN | 0 | 0 | 20 | 50 | 70 | 100 | 120 | 150 | 170 |

PM (mmHg · abs)

TABLE 2

| PM | 100 | 200 | 300 | 400 | 500 | 600 | 700 | 800 |
|---|---|---|---|---|---|---|---|---|
| TPSUB | 5 | 100 | 100 | 100 | 100 | 110 | 120 | 130 |

PM (mmHg · abs)

At a point 92, the MPU 62 finds a second pulse width TPNE, using the measured engine running speed NE, from a one-dimensional function table, such as that shown in Table 3, which shows the relationship between engine speed NE and second pulse width TPNE'. Interpolation is also used to find the TPNE' corresponding to NE. Since the LSB of the NE-TPNE' function table of Table 3 is expressed in units of 8 microseconds, the actual TPNE is obtained by multiplying the TPNE' take from the table by eight. That is, the TPNE is obtained from the equation $TPNE=TPNE'\times 8$.

TABLE 3

| NE | 500 | 1000 | 2000 | 3000 | 3500 | 4000 | 5000 | 6000 |
|---|---|---|---|---|---|---|---|---|
| TPNE' | 65 | 80 | 100 | 90 | 100 | 90 | 60 | 30 |

NE (rpm)

At a point 93, the MPU 62 finds a correction coefficient TPKNE, using the measured engine running speed NE, from a one-dimensional function table, such as that shown in Table 4, which shows the relationship between engine speed NE and correction coefficient TPKNE'. Interpolation is also used in this case to find the TPKNE' corresponding to NE. The LSB of the NE-TPKNE' function table of Table 4 is expressed in units of 1/512. Therefore, the actual TPKNE is obtained by using the following equation, in which A and B are constants.

$$TPKNE = \frac{TPKNE'}{A} + B$$

TABLE 4

| NE | 500 | 1000 | 2000 | 2500 | 3000 | 4000 | 5000 | 6000 |
|---|---|---|---|---|---|---|---|---|
| TPKNE' | 50 | 70 | 100 | 110 | 99 | 150 | 170 | 140 |

NE (rpm)

At a point 94, the MPU 62 calculates a basic pulse width TP, using the TPBSE, TPNE, and TPKNE taken from the tables, from the following equation.

$$TP=(TPBSE+TPNE)TPKNE$$

Here, TP may be obtained by multiplying the sum of TPBSE and TPNE by TPKNE, or by adding the product of TPBSE and TPKNE with the product of TPNE and TPKNE.

Then, at a point 95, the MPU 62 calculates a final pulse width TAU based upon the basic pulse width TP, correction coefficients $\alpha$ and $\beta$, and the dead injection pulse width TV of the fuel injectors 30, according to the following equation, $$TAU=TP\cdot\alpha+\beta+TV$$

The calculated data for the pulse width TAU is stored in a predetermined position of the RAM 68 at a point 96.

There are various methods for producing an injection signal having a duration corresponding to the calculated pulse width TAU. One method is as follows. First, the injection signal is switched from "0" to "1", and the contents of the free-run counter read out when a fuel-injection initiation pulse is produced. The contents read out are used to calculate, a value corresponding to the contents of the free run counter after the time for TAU has elapsed from the development of the fuel-injection initiation pulse. The calculation values is sent to a compare register. When the contents of the free-run counter become equal to the contents of the compared register, an interrupt-request signal is produced to switch the injection signal back from "1" to "0". This produces, an injection signal having a duration corresponding to TAU. The above fuel-injection initiation pulse is produced for each interrupt-processing routine of 30° crank angle shown in FIG. 4.

Figure 6A:
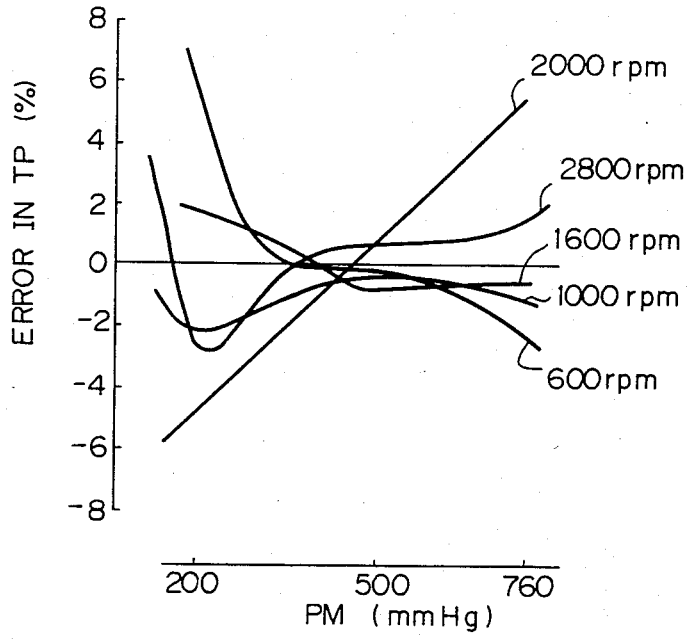
FIGS. 6*a* and 6*b* are graphs showing the percentage error in the calculated basic pulse width TP.
Figure 6B:
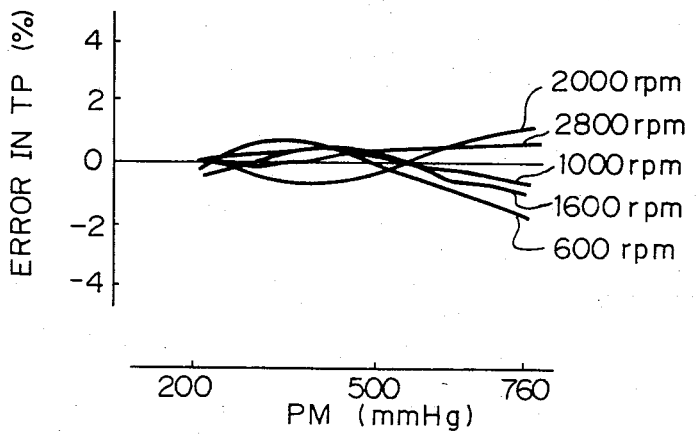

FIG. 6*a* illustrates the percentage error in the basic pulse width TP calculated from the equation $TP=TPBSE\times TPKNE$ according to the preceding method, and FIG. 6*b* illustrates the percentage error in the basic pulse width TP calculated from the equation $$TP=(TPBSE+TPNE)TPKNE$$

according to the present invention.

As is apparent from FIG. 6*a*, if TP is calculated from $TP=TPBSE\times TPKNE$, there occurs large errors with respect to the TP required by the engine. However, as shown in FIG. 6*a*, if TP is calculated from $TP=(\mathrm{TPBSE}+\mathrm{TPNE})\times TPKNE$, where the engine speed function TPNE is provided in the summed term, the error in the calculated TP, relative to the TP required by the engine can be greatly reduced. Therefore, according to the present invention, a basic pulse width correct to only a small error can be obtained without increasing the number of steps in the control program or the storage capacity required for the function tables used to calculate the basic pulse width. As a result, the exhaust gas purification and other operating characteristics of the engine, particularly during transitional operating states, can be greatly improved. Because the length of the control program and the storage capacity do not need to be increased, increases in the manufacturing costs and design complications can be avoided.

Many widely different embodiments of the present invention may be constructed without departing from the spirit and scope of the present invention. It should be understood that the present invention is not limited to the specific embodiments described in this specification, except as defined in the appended claims.

We claim:

1. An apparatus for controlling the fuel supply of an internal combustion engine comprising:

means for detecting the intake manifold pneumatic pressure and producing a first electrical signal;

means for detecting the engine running speed and producing a second electrical signal;

means for calculating, in response to said first electrical signal, a first fuel supply amount TPBSE from at least one one-dimensional function the variable for which is the intake manifold pneumatic pressure;

means for calculating, in response to said second electrical signal, a second fuel supply amount TPNE from a one-dimensional function the variable for which is the engine running speed;

means for calculating, in response to said second electrical signal, a correction coefficient TPKNE from a one-dimensional function the variable for which is the engine running speed;

means for calculating, from said first and second fuel supply amounts TPBSE and TPNE and from said correction coefficient TPKNE, a third fuel supply amount TP, said calculation being performed by using the function $TP=(TPBSE+TPNE)TPKNE$; and means for adjusting, in accordance with said calculated third fuel supply amount, the actual fuel supply to the engine.

2. An apparatus as claimed in claim 1, wherein said first fuel supply amount calculating means includes means for calculating, in response to said first electrical signal, a first fuel supply amount TPBSE by using a one-dimensional function table that shows the relationship between the intake manifold pneumatic pressure and the first fuel supply amount TPBSE.

3. An apparatus as claimed in claim 1, wherein said first fuel supply amount calculating means includes:

means for calculating, in response to said first electrical signal, a main value of said first fuel supply amount by using a one-dimensional function table that shows the relationship between the intake manifold pneumatic pressure and the main value;

means for calculating, in response to said first electrical signal, a subvalue of said first fuel supply amount by using a one-dimensional function table that shows the relationship between the intake manifold pneumatic pressure and the subvalue; and means for summing said main value and said subvalue to obtain the first fuel supply amount TPBSE.

4. An apparatus as claimed in claim 1, wherein said third fuel supply amount calculation means includes means for multiplying the sum of said calculated first and second fuel supply amounts TPBSE and TPNE by said calculated correction coefficient TPKNE.

5. An apparatus as claimed in claim 1, wherein said third fuel supply amount calculation means includes means for adding the product of said calculated first fuel supply amount TPBSE and said calculated correction coefficient TPKNE with the product of said calculated second fuel supply amount TPNE and said calculated correction coefficient TPKNE.

* * * * *